US009988250B2

(12) United States Patent
Hall et al.

(10) Patent No.: US 9,988,250 B2
(45) Date of Patent: Jun. 5, 2018

(54) DRUM FOR A MOTORIZED LIFTING/PULLING DEVICE

(71) Applicant: David R. Hall, Provo, UT (US)

(72) Inventors: David R. Hall, Provo, UT (US); Jerome Miles, Spanish Fork, UT (US); Joe Fox, Spanish Fork, UT (US)

( * ) Notice: Subject to any disclaimer, the term of this patent is extended or adjusted under 35 U.S.C. 154(b) by 331 days.

(21) Appl. No.: 15/058,585

(22) Filed: Mar. 2, 2016

(65) Prior Publication Data

US 2017/0253469 A1 Sep. 7, 2017

(51) Int. Cl.
*B66D 1/38* (2006.01)
*B66D 1/30* (2006.01)
*B66D 1/12* (2006.01)

(52) U.S. Cl.
CPC ..... *B66D 1/38* (2013.01); *B66D 1/30* (2013.01); *B66D 1/12* (2013.01); *B66D 2700/0141* (2013.01); *B66D 2700/0183* (2013.01); *B66D 2700/0191* (2013.01)

(58) Field of Classification Search
CPC ... B66D 1/36; B66D 1/38; B66D 1/42; B66D 2700/0191
USPC ..... 242/602–602.3
See application file for complete search history.

(56) References Cited

U.S. PATENT DOCUMENTS 1,935,975 A * 11/1933 Donandt ..... B66D 3/10 242/157.1
2,204,938 A * 6/1940 Le Bus ..... B65H 75/265 242/602.1
2,348,987 A * 5/1944 Lock ..... B66D 1/38 200/47
3,843,094 A * 10/1974 Watts ..... B66D 1/36 242/366
3,966,170 A * 6/1976 McKenna ..... B66D 1/741 254/280
4,142,465 A * 3/1979 Kemp ..... B41F 31/301 101/330
4,494,427 A * 1/1985 Pechau ..... B23D 25/12 83/306
4,827,752 A * 5/1989 Alcock ..... B21C 1/08 242/156.1
5,050,813 A * 9/1991 Ishikawa ..... B65H 75/36 24/129 R
5,494,235 A * 2/1996 Vowles ..... B65H 75/42 137/355.2
6,234,226 B1 * 5/2001 Kitahashi ..... F16L 55/1655 138/97
7,104,492 B1 * 9/2006 Massell ..... B66D 1/36 242/397
2009/0072074 A1 * 3/2009 Tsai ..... B65H 49/205 242/602

(Continued)

*Primary Examiner* — Emmanuel M Marcelo

(57) ABSTRACT

An apparatus for providing reliable line spooling for hoists, winches, and other pulling and/or lifting devices is disclosed. In one embodiment, such an apparatus includes a motor and a drum rotated by the motor to draw in or let out a line from the drum. The drum includes a helical groove formed in an outer surface thereof to accommodate the line. A roller is provided to place pressure on the line against a groove in the drum. In certain embodiments, the drum comprises a groove which widens as it gets closer to the drum. In other embodiments, the groove is formed by sidewalls which are various shapes and dimensions allowing the line to be held in the groove.

20 Claims, 15 Drawing Sheets

(56) References Cited

U.S. PATENT DOCUMENTS

| | | | | |
|---|---|---|---|---|
| 2010/0032509 | A1* | 2/2010 | Cazzaro | B66D 1/38 242/397.3 |
| 2011/0056806 | A1* | 3/2011 | Johnson | B65G 21/18 198/778 |
| 2015/0284224 | A1* | 10/2015 | Hall | B66D 1/22 254/333 |
| 2015/0375975 | A1* | 12/2015 | Flateland | B66D 1/7405 254/310 |

* cited by examiner

DRUM FOR A MOTORIZED LIFTING/PULLING DEVICE

BACKGROUND

Field of the Invention

This invention relates to hoists, winches, and other pulling and/or lifting devices.

Background of the Invention

Hoists and winches are used extensively to lift, lower, or pull loads of various kinds. Such devices typically include a line, such as a cable or chain, wrapped around a spool. To lift, lower, or pull a load, the spool may be manually rotated or driven with a motor, such as an electrical, hydraulic, or pneumatic motor. When rotation is not desired, a braking mechanism may be used to prevent the spool from turning. This may maintain tension in the line, keep a load suspended, or prevent the release or unspooling of the line. To keep the line from bunching on the spool, some hoists or winches may include guides or other mechanisms to evenly wind the line around the spool.

Although a wide variety of hoists and winches are available, many have shortcomings that prevent or discourage their use in various applications. For example, some hoists or winches are bulky or cumbersome, which may prevent their use in applications where greater compactness is required or desired. Other hoists and winches may be economically infeasible for use in applications such as consumer or residential applications due to their complexity or expense.

The accuracy and precision of some hoists and winches may also be lacking in certain applications. For example, because the line of a hoist or winch may be wound around itself in an irregular or unpredictable manner, the effective diameter of the spool may change for line that is drawn in or let out from the spool. The result is that, for any given angle of rotation of the spool, an unpredictable amount of line may be drawn in or let out. This can make the hoist or winch unsuitable for applications where a high degree of precision is required. It can also make the winch or hoist unsuitable for operations that require a high degree of repeatability.

Some hoists and winches may also have shortcomings in terms of the control and information they provide. For example, current hoists and winches may lack mechanisms for determining certain parameters during operation. For example, short of manually measuring or observing a hoist or winch, it may be difficult or impossible to determine how much line is let out from the hoist or winch at any given time. Even if possible, it may not be possible to do so with a desired degree of precision. In other cases, the ability to determine a load on the hoist or winch, or adjust the speed of a hoist or winch (which may depend on the load) may be lacking. In yet other cases, an event such as a power outage or reset may cause a hoist or winch to forget or lose information regarding current operating parameters.

As with most fields of endeavor, improvements are constantly sought after by those of skill in the art. As it relates to hoists and winches, improvements are needed to address bulkiness, complexity, expense, precision, and control, as discussed herein. Ideally, such improvements will create new applications for hoists or winches, or make hoists or winches more economically or practically feasible for existing applications.

SUMMARY

The disclosed invention has been developed in response to the present state of the art and, in particular, in response to the problems and needs in the art that have not yet been fully solved by currently available apparatus and methods. Accordingly, apparatus and methods in accordance with the invention have been developed to provide improved spooling for motorized lifting/pulling devices. The features and advantages of the invention will become more fully apparent from the following description and appended claims, or may be learned by practice of the invention as set forth hereinafter.

Consistent with the foregoing, an apparatus for providing reliable spooling for hoists, winches, and other pulling and/or lifting devices is disclosed. In one embodiment, such an apparatus includes a motor and a drum rotated by the motor to draw in or let out a line from the drum. The drum includes a helical groove formed in an outer surface thereof to accommodate the line. A roller is provided to place pressure on the line against a groove in the drum. This drum may have a groove which assists in holding the line tight against the drum. In certain embodiments, the drum comprises a groove which widens as it gets closer to the drum. In other embodiments, the groove is formed by sidewalls which are various shapes and dimensions allowing the line to be held in the groove. A corresponding method is also disclosed and claimed herein.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
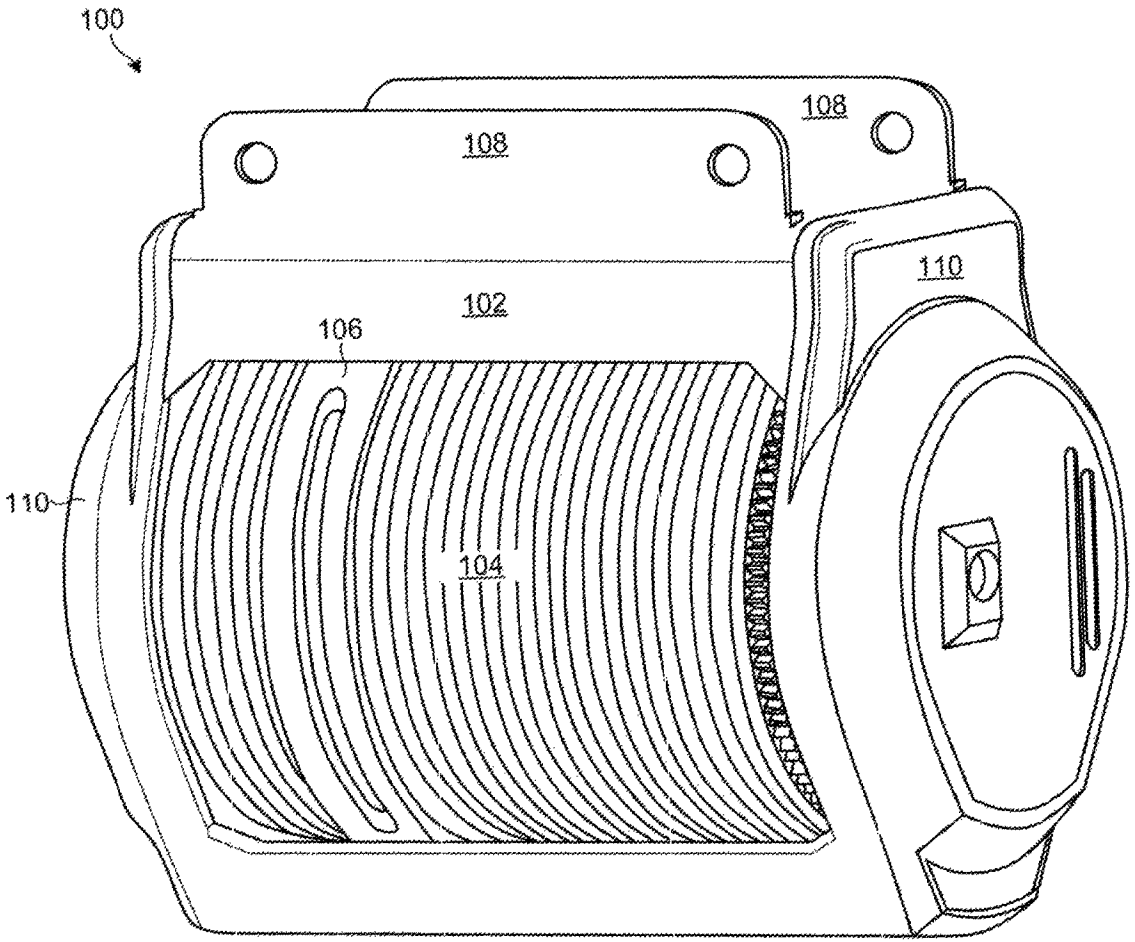
FIG. 1 is a perspective view showing one embodiment of a motorized lifting device with line removed.
Figure 2:
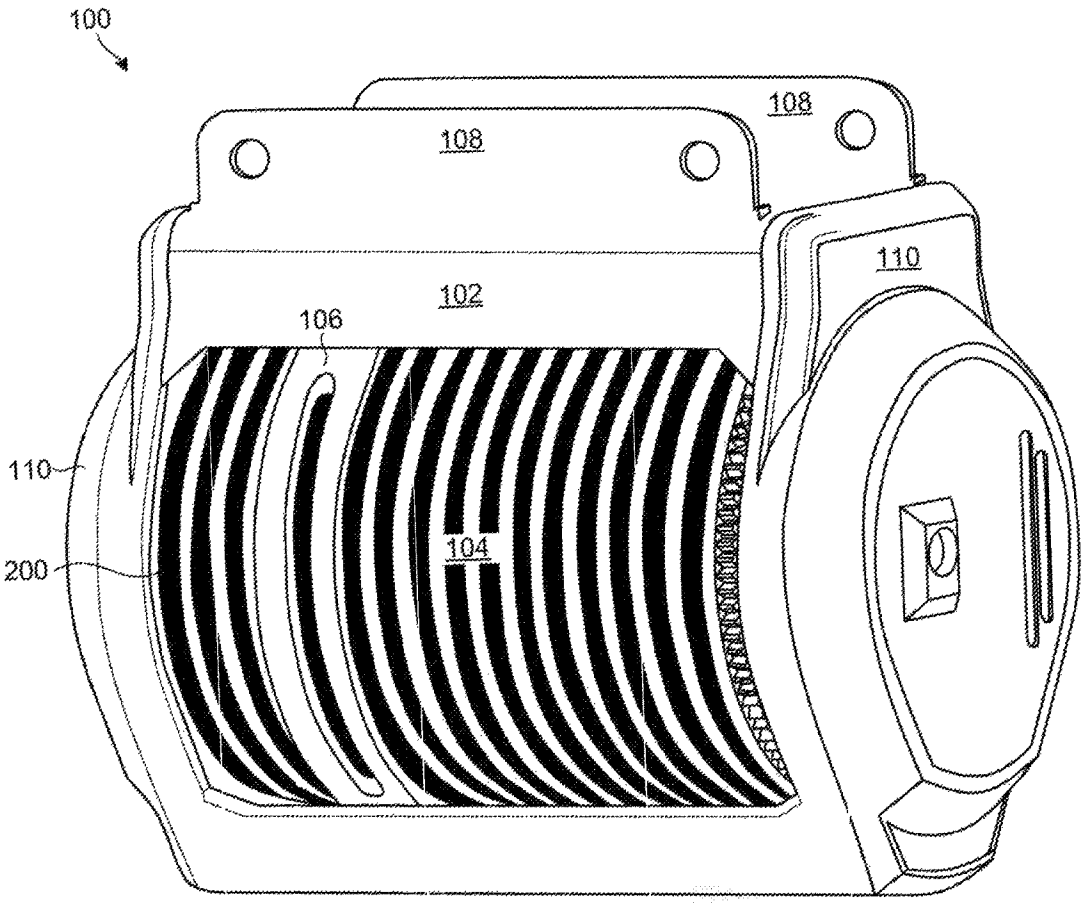
FIG. 2 is a perspective view of the motorized lifting device of FIG. 1, with line on the drum.

Referring to FIGS. 1 and 2, a perspective view showing one embodiment of a motorized lifting device 100 in accordance with the invention is illustrated. FIG. 1 is a perspective view of the motorized lifting device 100 without line 200 on the drum 104. FIG. 2 is a perspective view of the motorized lifting device 100 with a line 200 on the drum 104. Although the motorized lifting device 100 is described herein primarily as it relates to lifting objects, the device 100 may also be used to pull loads in the manner of conventional winches. Thus, nothing in this disclosure should be interpreted as indicating that the motorized lifting device 10 is only suitable for lifting. Many of the features and functions described herein related to lifting may be equally beneficial to pulling loads.

The motorized lifting device 100 illustrated in FIG. 1 may address a multitude of different shortcomings of the prior art, such as problems with bulkiness, precision, and control. Such improvements will ideally create new applications for hoists or winches, or make hoists or winches more economically or practically feasible for existing applications. The illustrated motorized lifting device 100 is compact relative to other devices with similar capability and function, and has features to provide improved precision and control. In some respects, the precision and control of the motorized lifting device 100 is similar to the precision and control provided by modern-day computer numerical control (CNC) machine tools. For example, the features and functions of the motorized lifting device 100 make it possible to know at all times where the end of the line 200 is, or position the end of the line 200 at a desired location. This capability enables a wide variety of other features and functions.

FIG. 1 provides an external view of one embodiment of a motorized lifting device 100 in accordance with the invention. Various internal features are hidden from view. Such internal features will be illustrated and described in the Figures and description that follow. As shown in FIG. 1, the motorized lifting device 100 includes a frame 102, a drum 104 for letting out or drawing in a line 200 (as shown in FIG. 2), a housing 110, and a passive guiding mechanism 106 for guiding the line 200 onto or off of the drum 104. In the illustrated embodiment, the drum 104 is grooved. Specifically, the drum 104 includes a continuous groove (e.g. a helical groove) around a circumference thereof. This allows the drum 104 to receive and retain the line 200 in the groove. The groove may receive the line 200 and prevent the line 200 from winding over itself as the drum 104 rotates. To fit within the groove, the line 200 may be equal to or shorter than a length of the groove. Because the line 200 is situated in the groove and the radius of the drum 104 is known, the amount of line 200 let out from or drawn into the motorized lifting device 100 may be precisely calculated from the angular position and number of rotations of the drum 104. Thus, the grooved drum 104 may enable precise calculations of how much line 200 is drawn in or let out from the motorized lifting device 100 at any given time.

The grooved drum 104 may be rotated by a motor and gearbox (not shown), which in the illustrated embodiment is substantially entirely contained within the grooved drum 104. This makes the motorized lifting device 100 very compact and potentially expands a number of applications for the device 100.

In the illustrated embodiment, the frame 102 of the motorized lifting device 100 includes a pair of flanges 108. The flanges 108 may enable the motorized lifting device 100 to be quickly and easily connected to a bracket (not shown) with pins, bolts, or other fasteners. Such a bracket may be attached to a ceiling joist, wall stud, or other structural member. The flanges 108 may also allow the motorized lifting device 100 to be quickly and easily removed or attached to another bracket in a different location. Thus, the motorized lifting device 100 may be configured for quick and easy attachment and removal from ceilings, walls, or the like.

Figure 3:
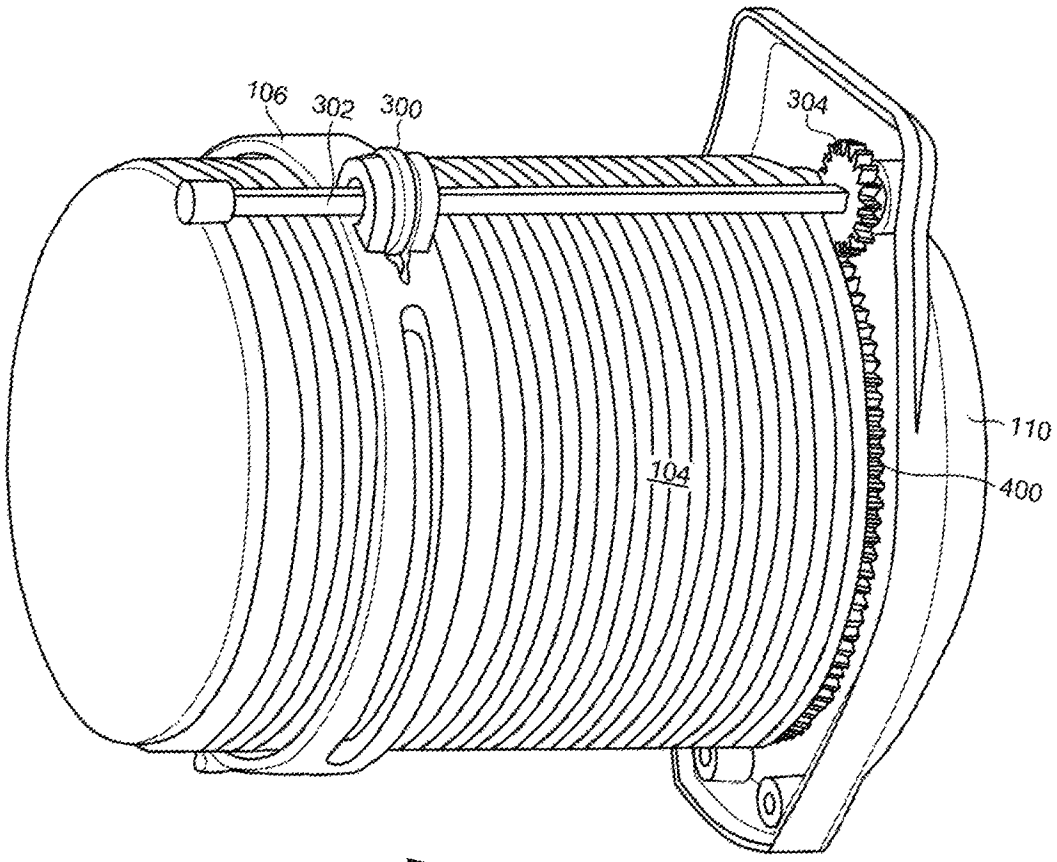
FIG. 3 is a perspective view of the motorized lifting device of FIG. 1, with the line and various components removed to show operation of the roller.
Figure 4:
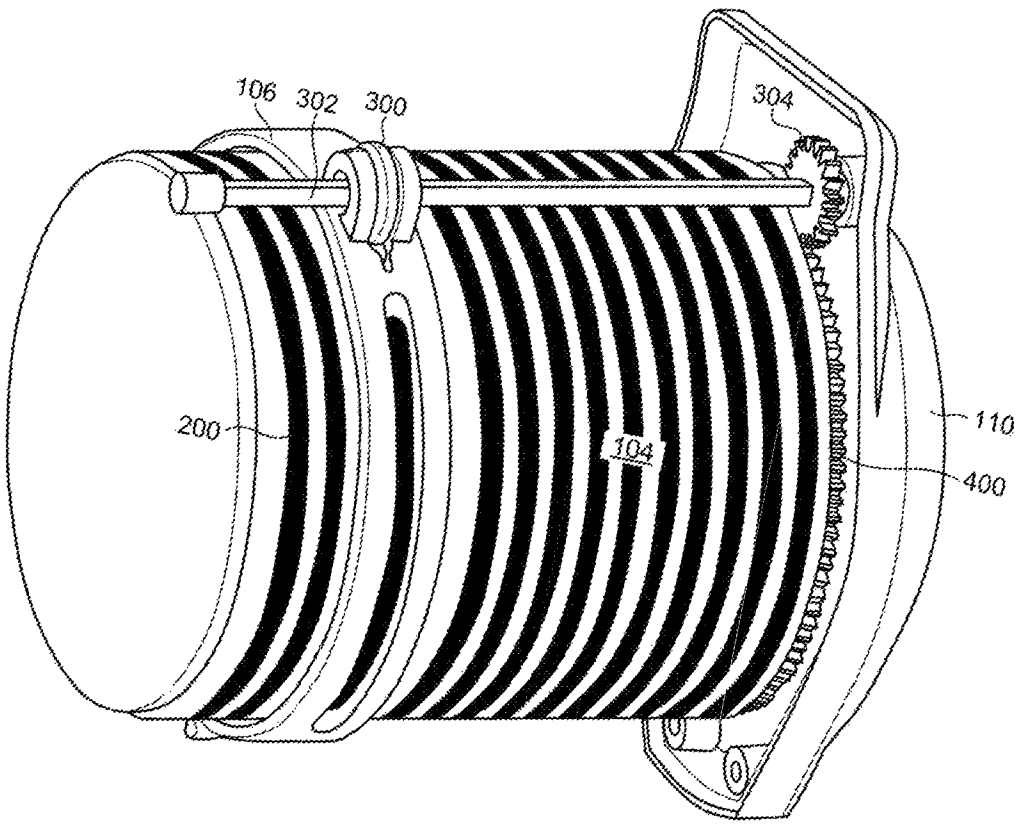
FIG. 4 is a perspective view of the motorized lifting device of FIG. 3, with line on the drum.

Referring to FIGS. 3 and 4, to assist in spooling line 200 onto and off of the drum 104, a roller 300 may be included in the motorized lifting device 100 that presses the line 200 against the drum 104. The roller 300 may comprise at least one indentation or groove 1205 which serves as a roller guide for line 200, shown in FIG. 12E. FIG. 3 is a perspective view of the motorized lifting device 100 of FIG. 1 with the line 200 and various components removed to show the roller 300. FIG. 4 is a perspective view of the motorized lifting device 100 of FIG. 3 with the line 200 on the drum 104.

In the illustrated embodiment, the roller 300 is rotated by a shaft 302, which is in turn coupled to a gear 304. The ends of the shaft 302 may be supported by the housing 110. In certain embodiments, the cross-sectional shape of the shaft 302 is keyed to engage a corresponding shape in the roller 300 and/or gear 304. For example, in the illustrated embodiment, the shaft 302 has a square cross-section that engages a corresponding shape in the roller 300 and gear 304, thereby allowing power to be transmitted from the gear 304 to the roller 300. Other cross-sectional shapes are possible and within the scope of the invention.

As shown, the gear 304 engages teeth 400 incorporated into the drum 104. The size of the gear 304 may be selected to enable the roller 300 to rotate a desired speed. Ideally, an outer circumference of the roller 300 will move at substantially the same speed as an outer circumference of the line 200 around the drum 104. This will prevent binding and/or slipping that may occur as a result of mismatched speeds. In general, to match the speeds, the outer diameter of the gear 304 will be roughly the same as the outer diameter of the roller 300.

As the drum 104 rotates, the roller 300 may be configured to track the line 200 as it spools onto or off of the drum 104. That is, the roller 300 may slide along the shaft 302 so that the roller 300 stays immediately over the line 200 at the point where it spools onto or off of the drum 104. This tracking may be effectuated by the passive guiding mechanism 106 previously described. The roller may track while extending into the groove immediately over the line in order to push the line into the groove. In certain embodiments, the passive guiding mechanism 106 may track the helical groove in the drum 104 to slide the roller 300 along the shaft 302. Stated otherwise, as the drum 104 turns, the passive guiding mechanism 106 may slide in a direction substantially perpendicular to the groove in the drum 104 to move the roller 300 along the shaft 302. In this way, the roller 300 may stay positioned over the line 200 as the line 200 spools onto or off of the drum 104.

In order to effectively spool the line 200 onto or off of the drum 104, the roller 300 may, in certain embodiments, be pre-loaded to place a certain amount of pressure on the line 200 against the drum 104. This allows the line 200 to be gripped between the roller 300 and drum 104. In certain embodiments, the line 200 is fabricated from a synthetic material (e.g., plastic, nylon, polyvinylidene fluoride, polyethylene, etc.) that can be compressed somewhat by the roller 300 against the drum 104. This may enable the line 200 to be more easily gripped and enable looser tolerances between the roller 300 and drum 104. Nevertheless, in other embodiments, the line 200 may be made of metal or metal alloys, such as a steel, and may be bare or coated with materials such as various plastics. The line 200 may be either monofilament or include multiple filaments, such as with a braided line 200.

In certain embodiments, the roller 300 may be spring-loaded against the drum 104 so that excess space (due to variations in the drum 104, roller 300, line 200, etc.) may be taken up by the roller 300. This may assist in providing a desired amount of pressure against the line 200 and allow for greater tolerances in the roller 300, line 200, and/or drum 104. The roller 300 may also, in certain embodiments, be made or coated with a material to assist in gripping the line 200. For example, the roller 300 may be made of or coated with a rubber, rubber-like, elastomeric, tacky, textured, and/or compressible material to more effectively grip the line 200.

Figure 5:
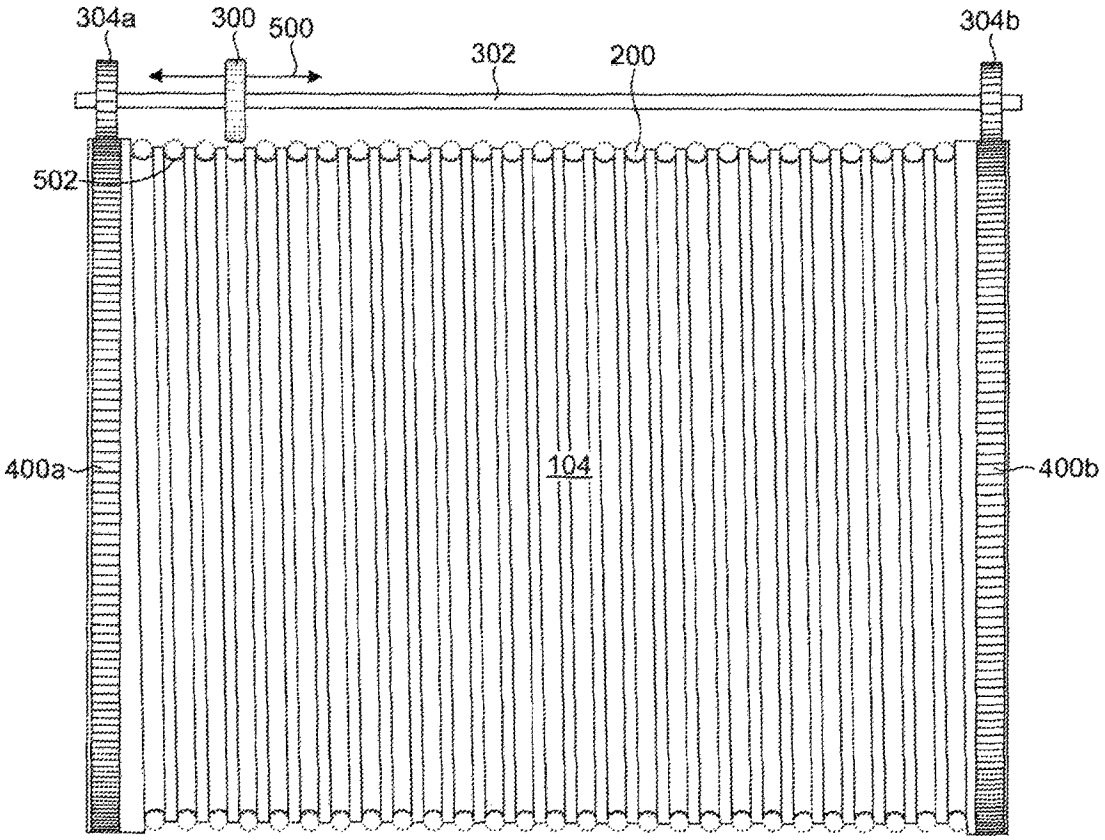
FIG. 5 is a side view of one embodiment of a grooved drum and roller that tracks the line on the drum, wherein the roller extends over a single coil of the line.

Referring to FIG. 5, a side view of a grooved drum 104 and roller 300 that tracks the line 200 on the drum 104, is illustrated. In this embodiment, the roller 300 extends over a single coil of the line 200. The roller 300 moves in directions 500 along the shaft 302 as the line 200 spools onto and off of the drum 104. The roller 300 places pressure on the line 200 against the drum 104 to keep the line 200 from unraveling and prevent the introduction of slack into the line 200. A roller 300 extending over a single coil may be advantageous in that all the pressure of the roller 300 may be focused on a single location on the line 200. The roller may track and extend into the groove immediately over the line in order to push the line into the groove.

In the illustrated embodiment, the roller 300 is driven by a pair of gears 304*a*, 304*b* located at each end of the shaft 302. These gears 304*a*, 304*b* engage teeth 400*a*, 400*b* at each end of the drum 104. Multiple gears 304*a*, 304*b* may provide redundancy and reduce twisting and/or torque on the shaft 302. Nevertheless, multiple gears 304*a*, 304*b* may not be required or necessary. A single gear 304 at one end of the shaft 302 may be sufficient in certain embodiments.

As shown in FIG. 5, the drum 104 may be designed such that the line 200 extends above the top edge of the groove 502. That is, a depth of the groove 502 may be designed to be less than a diameter of the line 200. In certain embodiments, the depth of the groove 502 is approximately fifty percent of the diameter of the line 200. This will allow the roller 300 to contact the line 200 without touching or placing pressure on the drum 104, which would likely relieve pressure on the line 200.

Figure 6:
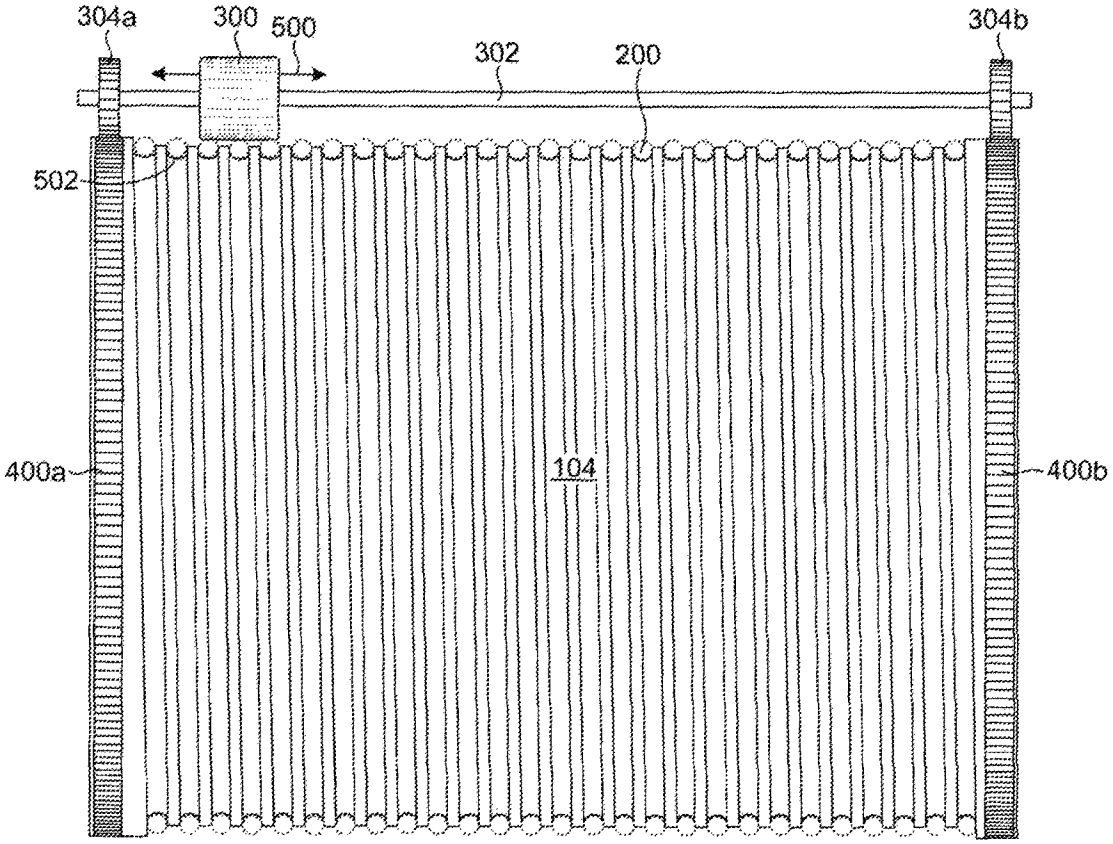
FIG. 6 is a side view of one embodiment of a grooved drum and roller that tracks the line on the drum, wherein the roller extends over multiple coils of the line.

Referring to FIG. 6, in certain embodiments, the roller 300 may be designed to extend over multiple coils of the line 200. In the illustrated embodiment, the roller 300 is configured to track the line 200 as it spools onto or off of the drum 104. Like the previous example, the roller 300 is powered by gears 304*a*, 304*b* at each end of the drum 104, although the roller 300 could also be powered by a single gear 304. The illustrated embodiment may be advantageous in that the roller 300 may have more leeway to track the line 200 (i.e., less accuracy is required). Because the roller 300 contacts multiple coils of the line 200, the roller 300 may be better at preventing unraveling or introduction of slack into the line 200.

Figure 7:
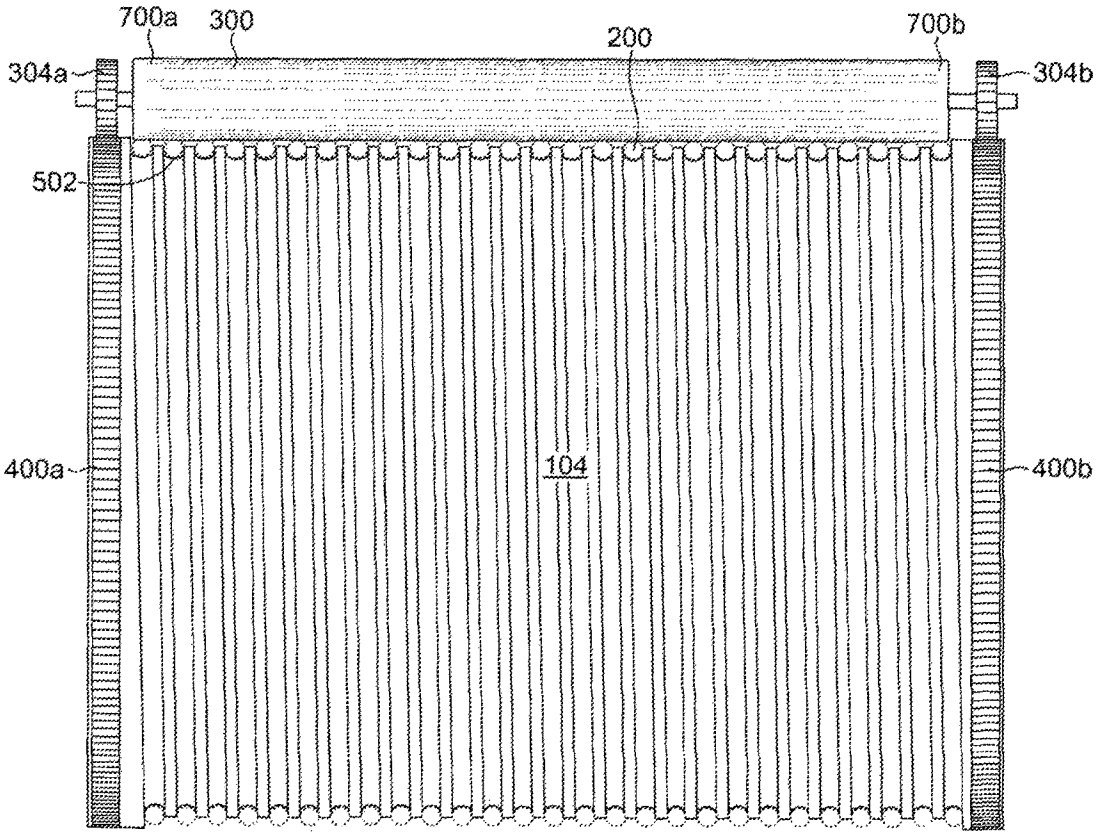
FIG. 7 is a side view of one embodiment of a grooved drum and roller that extends much of the length of the drum.

Referring to FIG. 7, in certain embodiments, the roller 300 may be designed to extend over most or all coils of the line 200. In the illustrated embodiment, the roller 300 is powered by gears 304*a*, 304*b* at each end of the drum 104, although the roller 300 could also be powered by a single gear 304. Because the roller 300 extends over all coils of the line 200, the roller 300 may remain stationary on the shaft 302. That is, the roller 300 may not slide along the shaft 302 as in previous embodiments. This design may reduce complexity and eliminate the need for a passive guiding mechanism 106.

The roller 300 may be made or coated with any suitable material in order to grip the line 200 and prevent slack in or unraveling of the line 200. Ideally, the roller 300 is made or coated with a rubber, rubber-like, elastomeric, tacky, textured, and/or compressible that will grip the line 200. The roller 300 may also be designed with a desired level of firmness. For example, the roller 300 be more firm to place more pressure on the line 200, or less firm to conform to the line 200. Similarly, the outer surface of the roller 300 may be substantially flat along the length of the roller 300 or the roller 300 may be shaped in a way that enables it to conform to the line 200. For example, grooves or indentations may be formed in the roller 300 around its circumference that align with the line 200 in the groove. Such a configuration may, in certain embodiments, improve the grip of the roller 300 on the line 200 by providing more surface area to contact the line 200.

Other modifications or variations are also possible to improve performance of the roller 300. For example, in certain embodiments, the roller 300 may be designed with a taper such that a first end 700*a* of the roller 300 has a slightly larger diameter than a second end 700*b* of the roller 300. The first end 700*a* may be positioned at or near the end of the drum 104 where the line 200 spools off first, and the second end 700*b* may be positioned at or near the end of the drum 104 where the line 200 spools off last. This design will ensure that the roller 300 places pressure on the line 200 where it is needed most, namely where the line 200 is currently spooling onto or off of the drum 104. For example, when all of the line 200 is on the drum 104, meaning that the groove 502 contains the line 200 along substantially its entire length, the tapered roller 300 will place the most pressure on the line 200 at or where its diameter is largest, namely at the first end 700*a*. However, as the line 200 spools off of the drum 104, this pressure will be relieved since no line 200 will be present to press against. Rather, the tapered design of the roller 300 will cause most of its pressure to be situated on the line 200 at the location where the line 200 is spooling off of the drum 104. This may be true for any length of line 200 that has been let out from the drum 104. This effect will also occur when the line 200 is spooled back onto the drum 104, namely that the tapered roller 300 will cause most of its pressure to be situated where the line 200 is spooling back onto the drum 104.

Figure 8:
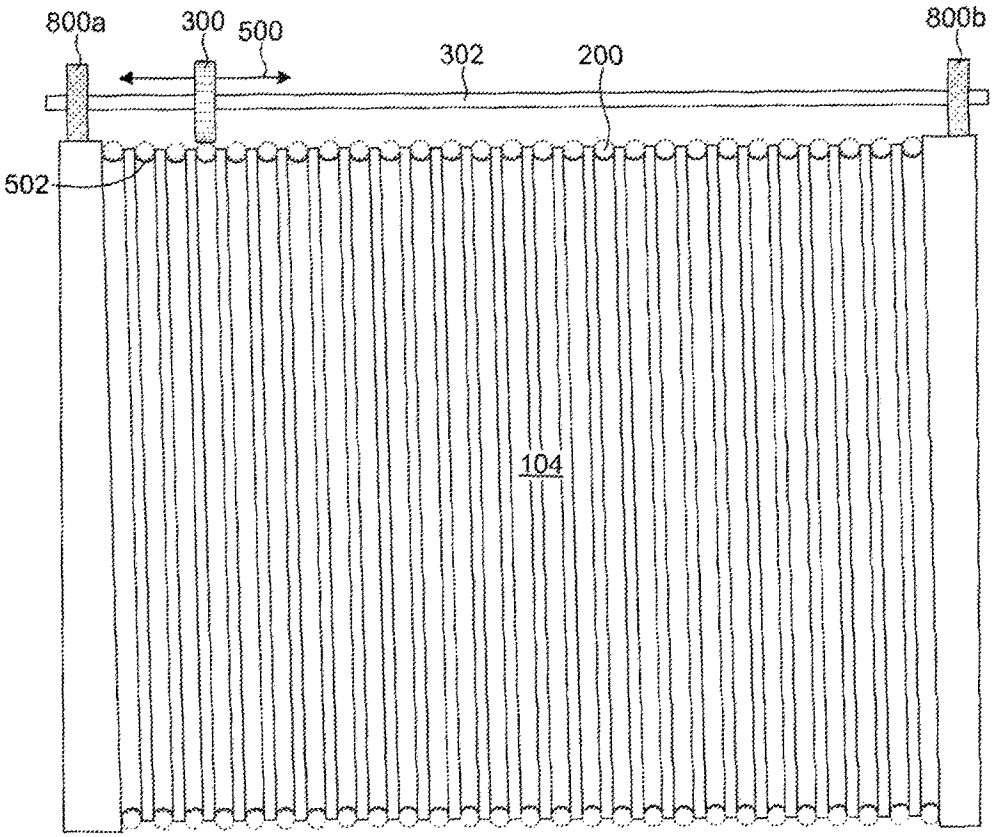
FIG. 8 is a side view of one embodiment of a grooved drum and roller that tracks the line on the drum, wherein the roller is driven by a wheel that makes contact with the drum.

Referring to FIG. 8, in certain embodiments, a roller 300 in accordance with the invention may be powered by one or more wheels 800*a*, 800*b* that are turned by the drum 104. These wheels 800*a*, 800*b* may be roughly the same diameter as the roller 300, thereby ensuring that a circumference of the roller 300 moves at substantially the same speed as a circumference of the line 200 around the drum 104. In the illustrated embodiment, the roller 300 is configured to track the line 200 as it spools onto or off of the drum 104. In order to prevent slippage between the wheels 800*a*, 800*b* and the drum 104, the wheels 800*a*, 800*b* may be made of or coated with a rubber, rubber-like, elastomeric, tacky, textured, and/or compressible material. Alternatively, or additionally, the drum 104 itself may be made of or coated with a rubber, rubber-like, elastomeric, tacky, textured, and/or compressible material along a circumference where the wheels 800*a*, 800*b* contact the drum 104. Use of wheels 800*a*, 800*b* as opposed to gears 304*a*, 304*b* may reduce cost and complexity, as well as ensure that a circumference of the roller 300 moves at substantially the same speed as a circumference of the line 200 around the drum 104.

Figure 9:
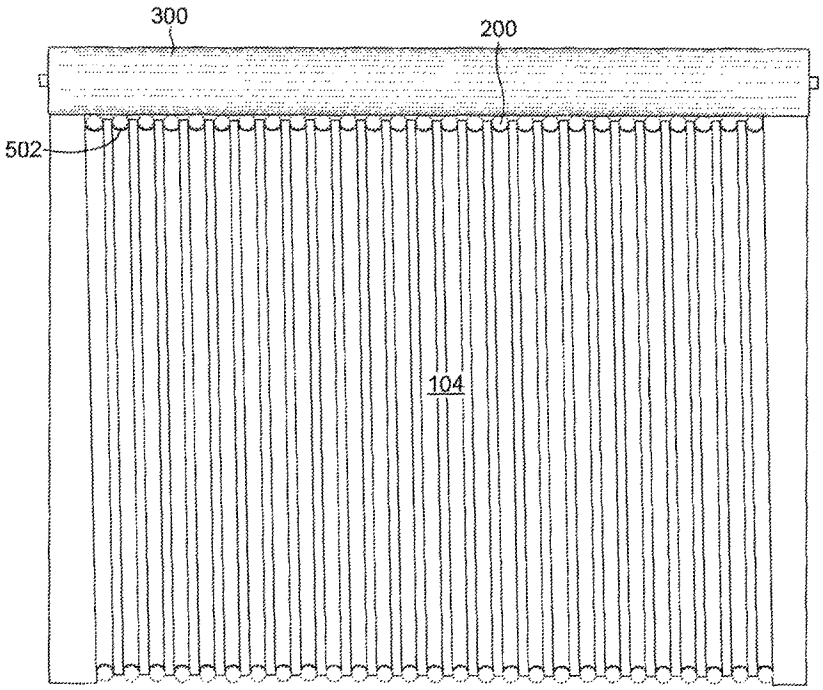
FIG. 9 is a side view of one embodiment of a grooved drum and roller that extends the length of the drum, wherein the roller itself is driven by the drum.

Referring to FIG. 9, in certain embodiments, the roller 300 may be designed to extend most or all of the length of the drum 104. This may allow the roller 300 to be directly driven by the drum 104. That is, ends 900*a*, 900*b* of the roller 300 may be directly driven by the drum 104, while a middle portion of the roller 300 may be used to spool the line 200 onto and off of the drum 104. In order to prevent slippage between the roller 300 and the drum 104, as well as enable the roller 300 to grip the line 200, the roller 300 may be made of or coated with a rubber, rubber-like, elastomeric, tacky, textured, and/or compressible material. Alternatively, or additionally, the drum 104 may be made of or coated with a rubber, rubber-like, elastomeric, tacky, textured, and/or compressible material where the roller 300 contacts the drum 104. The design illustrated in FIG. 9 may reduce complexity and cost compared to other designs.

Figure 10D:
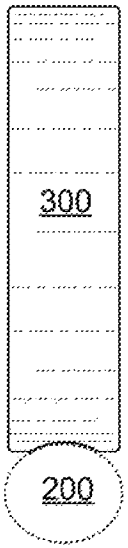
FIGS. 10A through 10D show various configurations of a roller and line for use with a motorized lifting device in accordance with the invention.
Figure 10C:
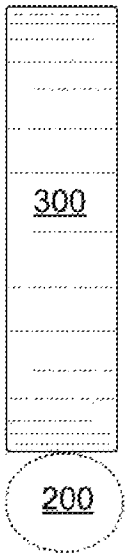
Figure 10B:
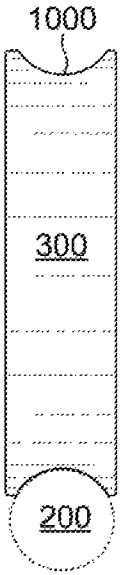
Figure 10A:
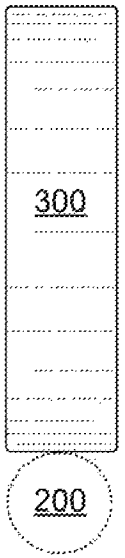

Referring to FIGS. 10A through 10D, the roller 300 previously described may contact and/or grip the line 200 in different ways. Although the roller 300 illustrated in FIGS. 10A through 10D has a width that extends over a single coil of the line 200, the same structures and techniques may be applied to rollers 300 that span multiple coils of line 200 or the entire drum 104, as shown in FIGS. 5 through 9. FIG. 10A shows a roller 300 with a substantially flat surface to contact the line 200. FIG. 10B shows one embodiment of a roller 300 with a groove 1000 or indentation 1000 that is designed to match or more closely conform to a contour of the line 200. Such an embodiment may increase surface contact between the roller 300 and the line 200, potentially increasing the grip thereon.

FIG. 10C shows one embodiment of a line 200 that may be compressed by the roller 300. Use of such a line 200 may improve the grip between the roller 300 and the line 200, as well as enable looser tolerances to be present between the roller 300 and drum 104. To enable such compression, the line 200 may, in certain embodiments, be fabricated from a synthetic material, such as plastic, nylon, polyvinylidene fluoride, polyethylene, or the like. The line 200 may be either monofilament or include multiple filaments, such as with a braided line 200. FIG. 10D shows one embodiment of a roller 300 that is fabricated from or coated with a material that is able to conform to the line 200. For example, the roller 300 may be made or coated with a rubber, rubber-like, elastomeric, and/or compressible material that is able to conform to the line 200 when pressure is placed thereagainst. This may increase the amount of surface contact between the roller 300 and line 200 to improve the grip therebetween. Such a roller 300 may be used in conjunction with a compressible or non-compressible line 200.

Figure 11:
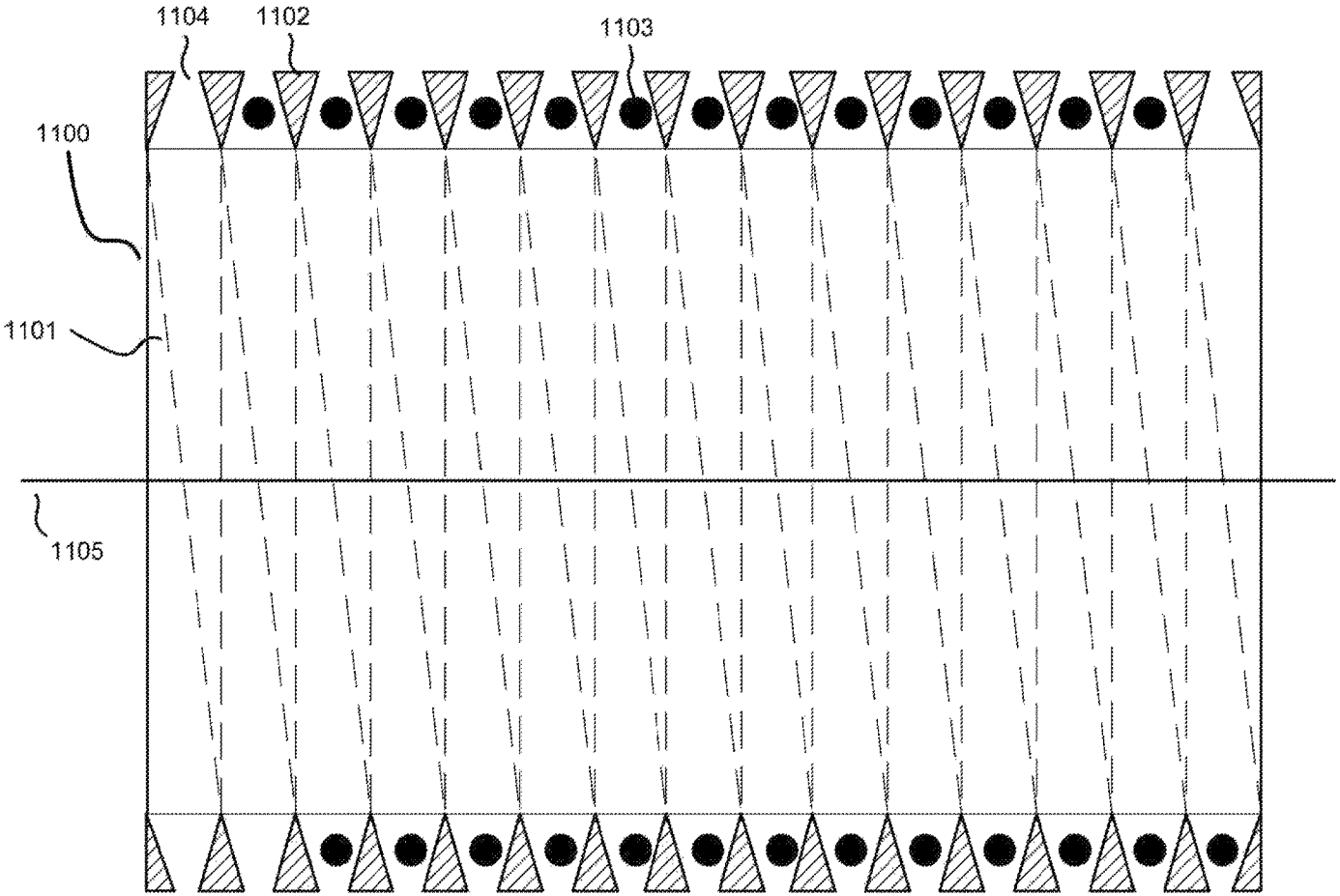
FIG. 11 is a cross-sectional view of a drum and line showing a center axis of the drum in accordance with an embodiment of the invention.
Figure 12:
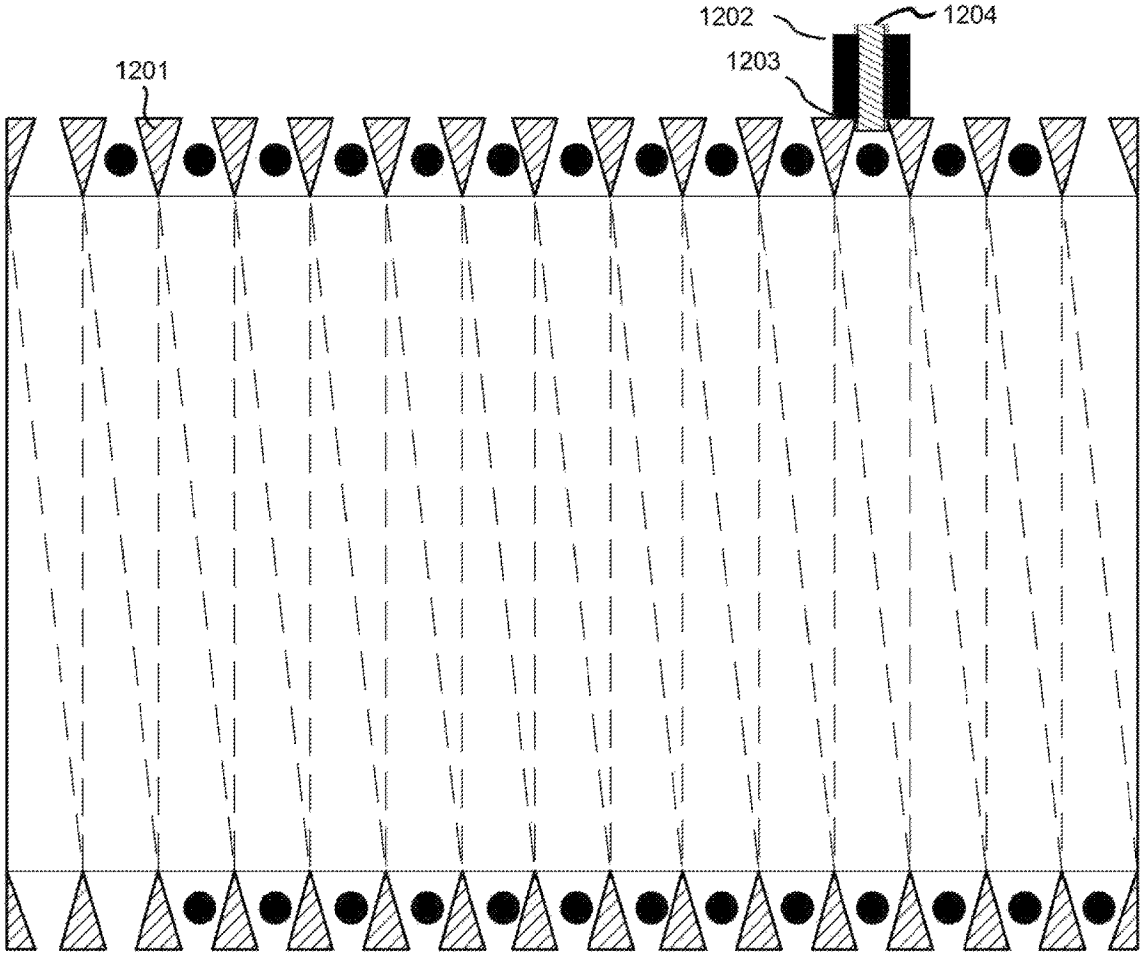
FIG. 12 is a cross-sectional view of a drum, roller and line in accordance with an embodiment of the invention.
Figure 13:
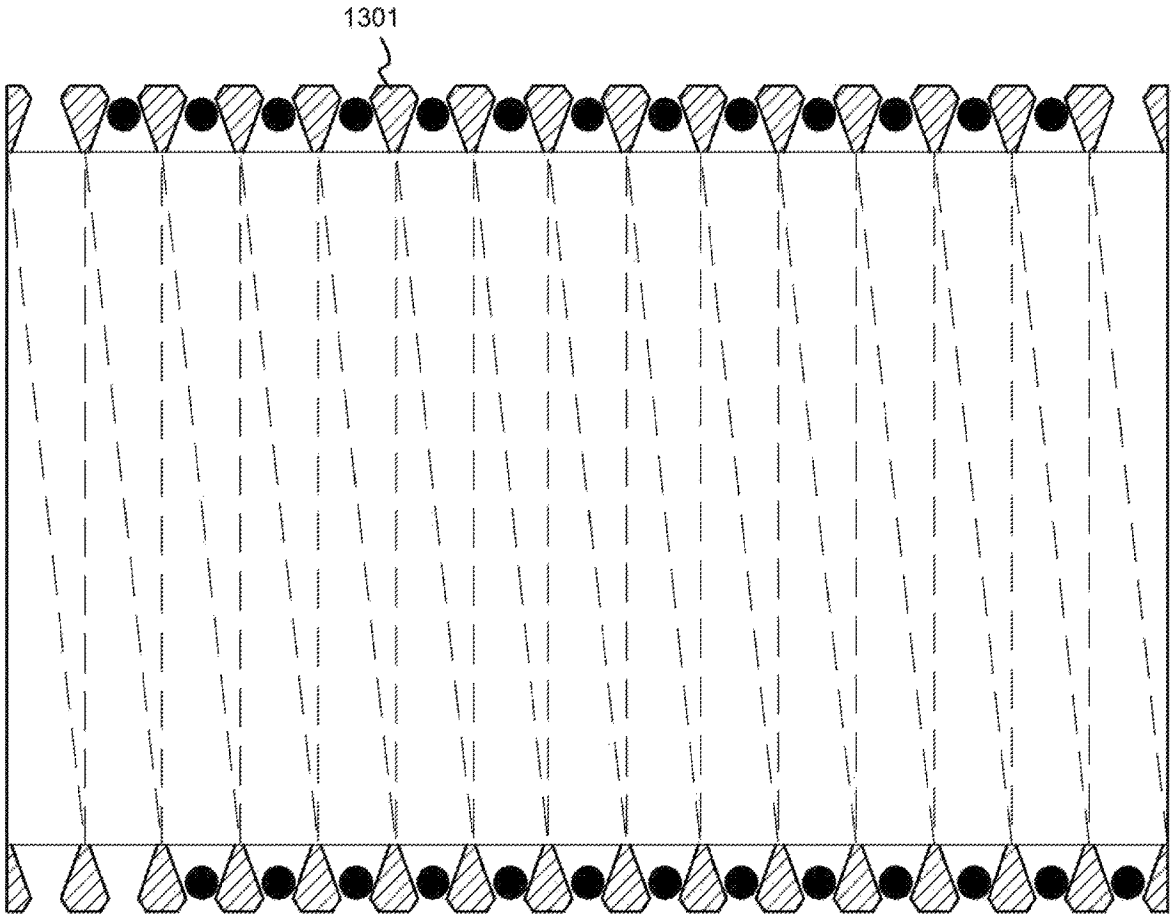
FIG. 13 is a cross-sectional view of a drum and line in accordance with an embodiment of the invention.
Figure 14:
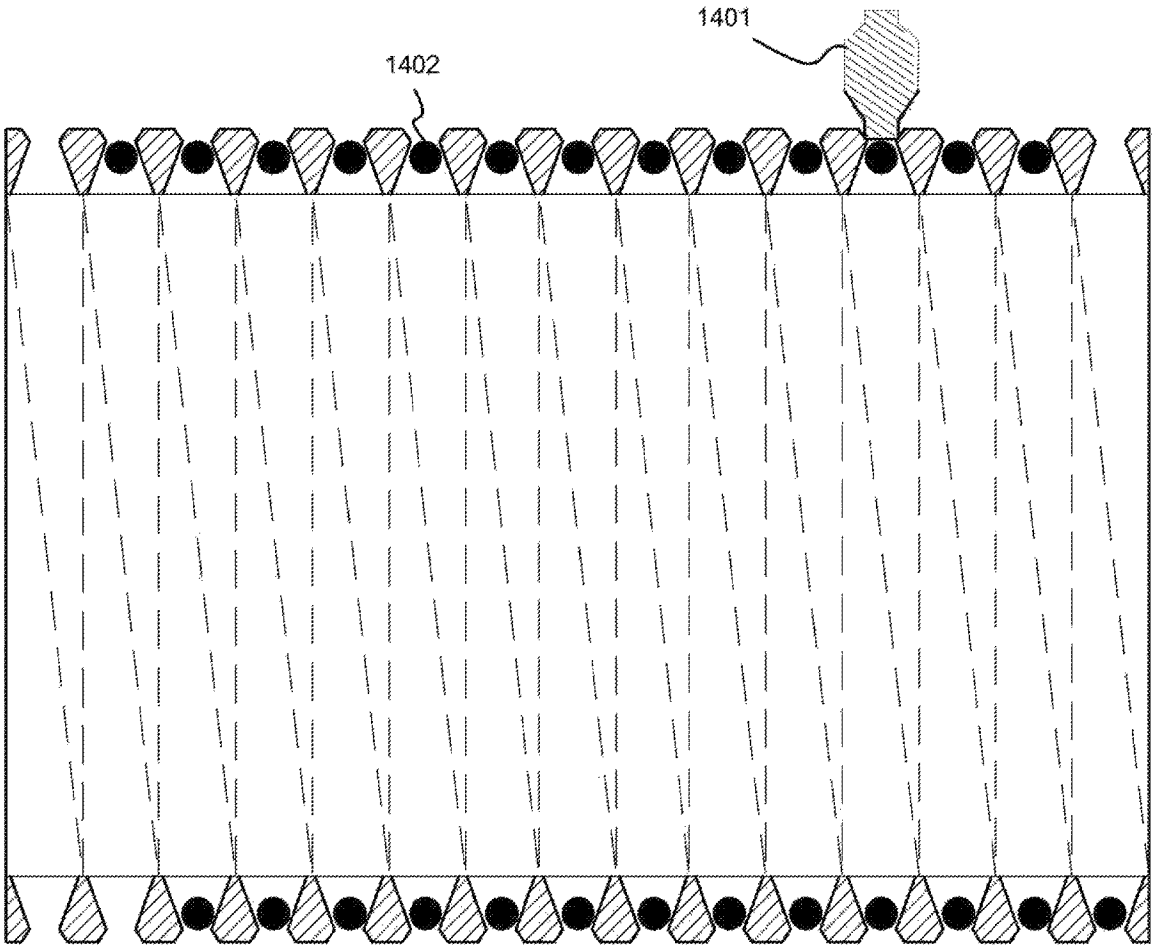
FIG. 14 is a cross-sectional view of a drum roller, and in accordance with an embodiment of the invention.
Figure 15:
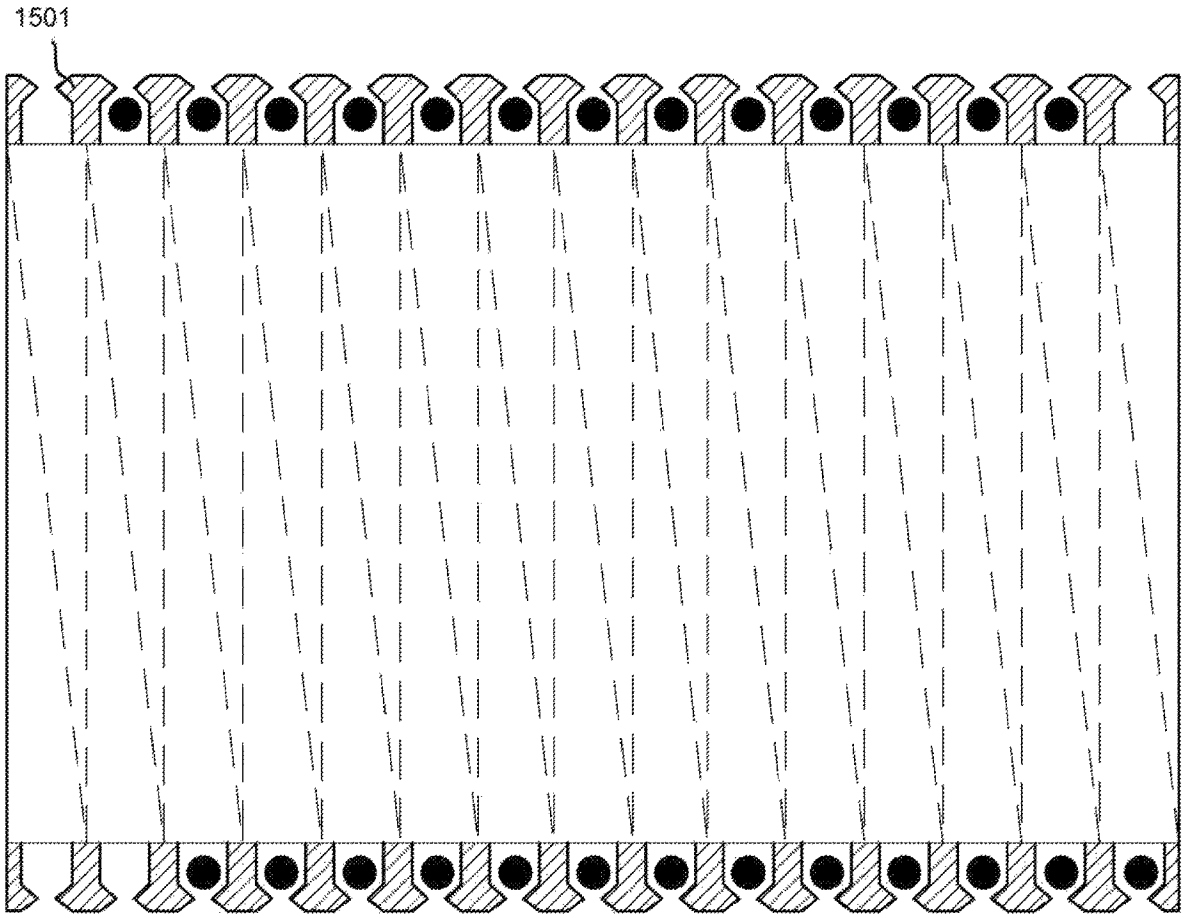
FIG. 15 is a cross-sectional view of a drum and line in accordance with an embodiment of the invention.

In FIGS. 11-15 show cross-sectional views of drums in accordance with embodiments of the invention. In FIG. 11, the cross-section of a groove sidewall 1102 of the drum is a triangular shape. A helical path 1101 around the drum 1100 is formed by grooved sidewalls 1102. The groove 1104 is formed by adjacent triangular sidewall shapes 1102. The groove sidewall 1102 maybe any shape or configuration which allows the line 1103 to be held to the drum 1100. The groove widens as it gets closer to a center axis 1105 of the drum body 1100. In FIG. 12, a roller 1204 is pushing the line into a drum groove. The roller 1104 is guided by an edge 1203 of a groove sidewall 1201 or by the roller section which protrudes into the groove or by both. The roller may be any shape or configuration which allows the roller to direct a line into the groove. The roller may include a sides 1202 for rolling on a surface of the groove sidewall 1201. In FIG. 13, the cross-section of the groove sidewall is similar to FIGS. 11 and 12 except that the corner of the triangle is cut off. This diamond shape 1301 may allow the roller to be guided as shown in FIG. 14. In FIG. 14, a roller guides line 1402 into a helical groove 1101 (shown in FIG. 11) with roller 1401. In FIG. 15, another variation of the shape of the groove sidewall 1501 is shown. This sidewall shape may allow for a greater pressure from a roller 1401 to be applied to a line or edge of the sidewall.

The apparatus and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An apparatus comprising:

a motor;

a drum rotated by the motor to draw in or let out a line from the drum, the drum comprising a groove formed in an outer surface thereof to accommodate the line, wherein the groove widens as it gets closer to a center axis of the drum; and a roller tracking and extending into the groove immediately over the line in order to push the line into the groove.

2. The apparatus of claim 1, wherein the groove forms a helical track around the drum.

3. The apparatus of claim 1, wherein the roller rolls against an edge of the groove.

4. The apparatus of claim 1, wherein the line is compressible.

5. The apparatus of claim 1, wherein the line diameter is larger than or equal to a narrowest portion of the groove.

6. The apparatus of claim 1, wherein the groove is configured to hold the line in the groove.

7. The apparatus of claim 1, wherein groove forms a guide for both of the line and the roller.

8. The apparatus of claim 1, wherein drum turns the roller by friction.

9. The apparatus of claim 1, wherein the roller is powered by same motor as the drum.

10. The apparatus of claim 1, wherein the roller is powered by a different motor than the motor which powers the drum.

11. A method comprising:

rotating a drum to draw in or let out a line from the drum, the drum comprising a groove formed in an outer surface thereof to accommodate the line, wherein the groove widens as it gets closer to a center axis of the drum; and pushing the line into the groove with a roller tracking and extending into the groove immediately over the line.

12. The method of claim 11, wherein the groove forms a helical track around the drum.

13. The method of claim 11, wherein the roller rolls against an edge of the groove.

14. The method of claim 11, wherein the line is compressible.

15. The method of claim 11, wherein the line diameter is larger than or equal to a narrowest portion of the groove.

16. The method of claim 11, wherein the groove is configured to hold the line in the groove.

17. The method of claim 11, wherein groove forms a guide for both of the line and the roller.

18. The method of claim 11, wherein drum turns the roller by friction.

19. The method of claim 11, wherein the roller is powered by same motor as the drum.

20. The method of claim 11, wherein the roller is powered by a different motor than the motor which powers the drum.

* * * * *